US007431665B2

(12) United States Patent
Sugimoto

(10) Patent No.: US 7,431,665 B2
(45) **Date of Patent: *Oct. 7, 2008**

(54) GOLF CLUB HEAD

(75) Inventor: Yasushi Sugimoto, Kobe (JP)

(73) Assignee: SRI Sports Limited, Kobe-shi (JP)

( * ) Notice: Subject to any disclaimer, the term of this patent is extended or adjusted under 35 U.S.C. 154(b) by 193 days.

This patent is subject to a terminal disclaimer.

(21) Appl. No.: 11/408,960

(22) Filed: Apr. 24, 2006

(65) Prior Publication Data

US 2006/0281582 A1 Dec. 14, 2006

(30) Foreign Application Priority Data

Jun. 13, 2005 (JP) ..... 2005-172652
Nov. 22, 2005 (JP) ..... 2005-337463

(51) Int. Cl.
*A63B 53/04* (2006.01)

(52) U.S. Cl. ..... 473/342; 473/349; 473/350

(58) Field of Classification Search ..... 473/324–350, 473/290–291

See application file for complete search history.

(56) References Cited

U.S. PATENT DOCUMENTS 5,106,094 A * 4/1992 Desbiolles et al. ..... 473/342
5,720,673 A * 2/1998 Anderson ..... 473/342
6,050,904 A * 4/2000 Kuo ..... 473/342
6,491,593 B2 * 12/2002 Takeda ..... 473/342
6,991,559 B2 * 1/2006 Yabu ..... 473/332
7,025,693 B2 * 4/2006 Sugimoto ..... 473/342
2005/0192116 A1 * 9/2005 Imamoto ..... 473/329
2006/0194645 A1 * 8/2006 Sugimoto ..... 473/342

FOREIGN PATENT DOCUMENTS

JP 2004-242952 A 9/2004

* cited by examiner

*Primary Examiner*—Sebastiano Passaniti
(74) *Attorney, Agent, or Firm*—Birch, Stewart, Kolasch & Birch, LLP

(57) ABSTRACT

A golf club head comprises a face plate and a head main body to which the face plate is attached so as to form a hollow behind the face plate. The face plate comprises a flange and a main portion having a front surface, rear surface and circumferential surface, and provided on the corner of the front surface and circumferential surface with a cut-off portion. The flange protrudes from the rear surface and extends along the peripheral edge of the main portion. The head main body provided at the front with an opening into which the face plate is fit. In the opening, a securing groove into which the flange is fit is provided. The securing groove is defined between an inner wall and an outer wall, and the outer wall extends to the front surface and provided at the front end thereof with a hook portion protruding into the above-mentioned cut-off portion.

10 Claims, 9 Drawing Sheets

GOLF CLUB HEAD

The present invention relates to a golf club head, more particularly to an improved structure of a junction of a face plate and main body capable of improving the rebound characteristic of the head.

An iron-type golf club head (b) composed of a face plate (c) and a head main body (d) as shown in FIG. 13 is disclosed in Japanese patent application publication No. 2004-242952. The head main body (d) is provided with a stepped hole (o) so that the step (f) can support the peripheral edge (e2) of the face plate.

If the face plate is increased in the unsupported area (g), the deflection of the face plate at impact increases and the rebound characteristic can be improved to increase the travel distance of a ball.

However, as the height WH of the club head is limited, if the unsupported length Wi is increased, then the support width Wc is decreased accordingly. As a result, the joint strength between the face plate and head main body is decreased. Thus, it is difficult to increase the unsupported area, without decreasing the joint strength.

It is therefore, an object of the present invention to provide a golf club head, in which the rebound characteristic and the strength of the junction of a face plate and a head main body can be improved.

According to the present invention, a golf club head comprises a face plate and a head main body to which the face plate is attached so as to from a hollow behind the face plate, wherein the face plate comprises a main portion and a flange, the main portion has a front surface, rear surface and circumferential surface and provided on the corner of the front surface and circumferential surface with a cut-off portion, the flange protrudes from the rear surface and extends along the peripheral edge of the main portion, the head main body is provided at the front with an opening into which the face plate is fit, wherein a securing groove into which the flange is fit is provided in the opening, the securing groove is defined between an inner wall and an outer wall, and the outer wall extends to said front surface and provided at the front end thereof with a hook portion protruding into said cut-off portion.

Embodiments of the present invention will now be described in detail in conjunction with the accompanying drawings.

Figure 1:
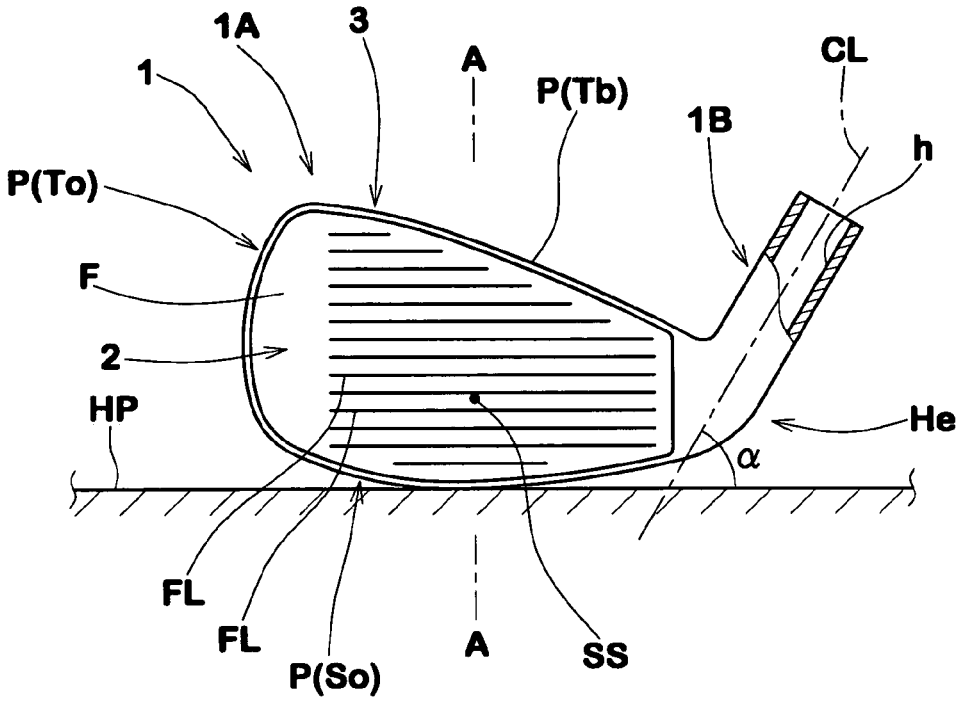
FIG. 1 is a front view of an iron-type golf club head according to the present invention.
Figure 2:
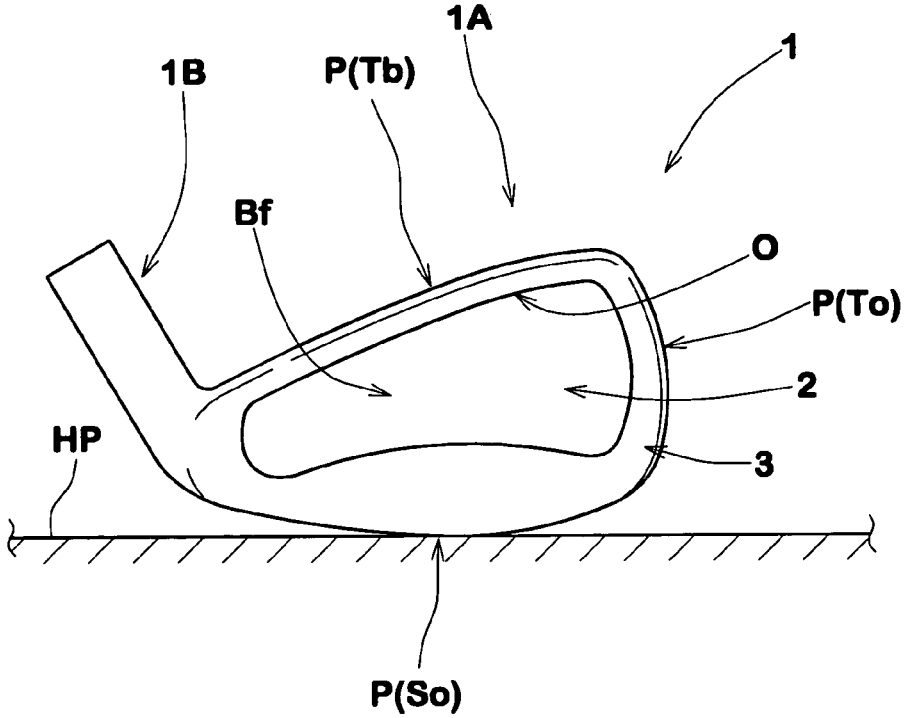
FIG. 2 is a rear view thereof.

In the drawings, golf club head 1 according to the present invention is an iron-type golf head having a top blade Tp, sole So, toe To and heel He. The head 1 comprises a main portion 1A and an upwardly protruding hosel portion 1B attached to the end of a club shaft (not shown).

The main portion 1A has a front surface F including the club face for hitting a ball, a back surface Bf and an outer circumferential surface P therebetween.

Figure 6:
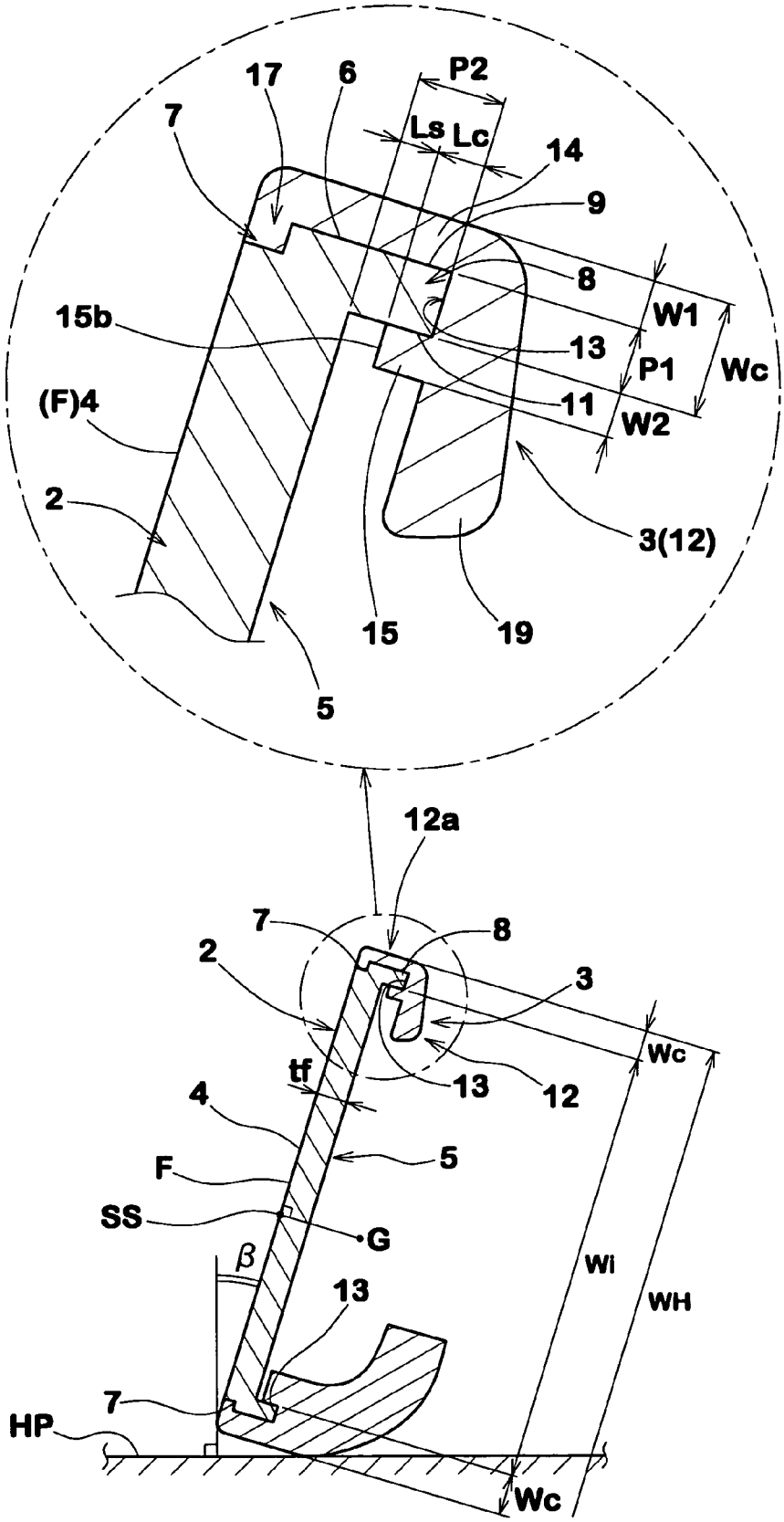
FIG. 6 is a cross-sectional view taken along line A-A of FIG. 1 showing an embodiment of the present invention.
Figure 8:
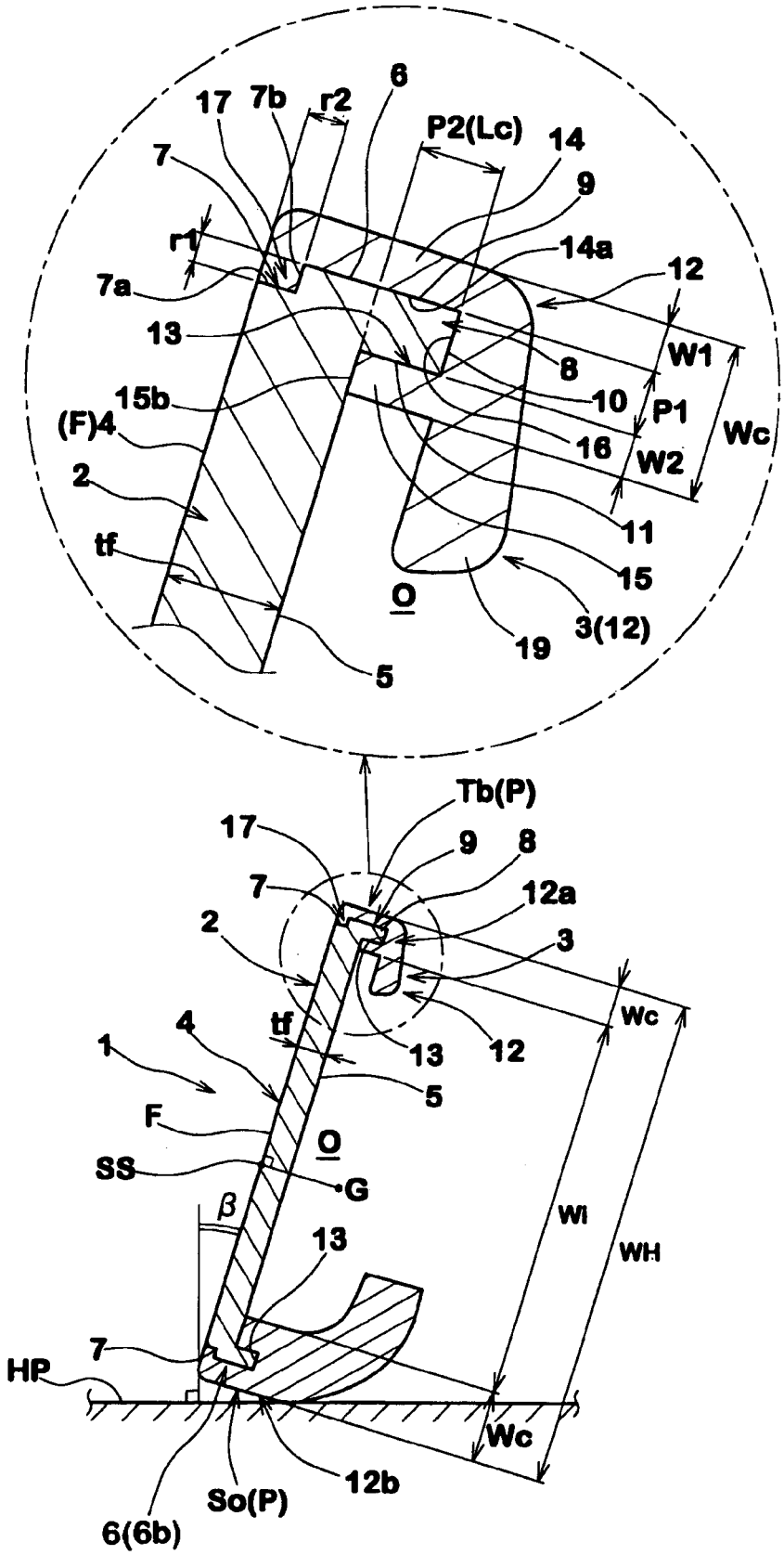
FIG. 8 is a cross-sectional view taken along line A-A of FIG. 1 showing still another embodiment of the present invention.

The hosel portion 1B is provided at the upper end thereof with a shaft inserting hole (h) into which the club shaft is inserted. As the center line of the inserted club shaft is aligned with the center line CL of the shaft inserting hole (h), the center line CL is usable to set the club head 1 alone in its standard state. Here, the standard state is such that the head 1 is put on a horizontal plane HP so as to satisfy its lie angle alpha and loft angle beta as shown in FIGS. 1, 2, 6 and 8. FIGS. 6 and 8 each show a cross section including the sweet spot SS and the center of gravity G of the club head and being perpendicular to the club face F and also perpendicular to the horizontal plane HP.

Figure 3:
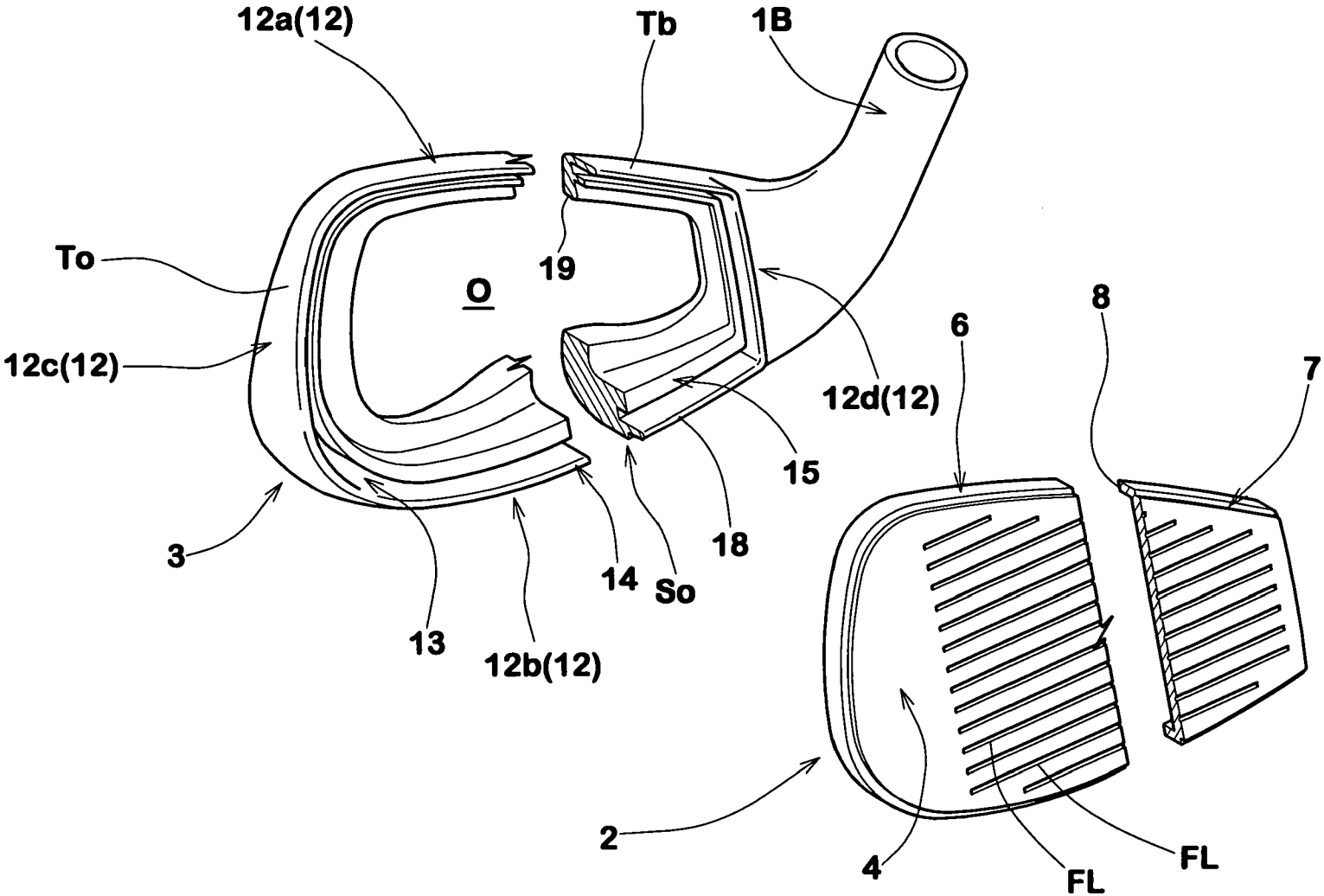
FIG. 3 is an exploded perspective view thereof.

In each embodiment, as shown in FIG. 3, the club head 1 has a two-piece structure comprising a face plate 2 of which front surface defines the substantially entirety of the front surface F of the main portion 1A, and a head main body 3 to which the face plate 2 is attached.

The face plate 2 and head main body 3 are made of metal materials. For the face plate 2, pure titanium, titanium alloys, aluminum alloys, maraging steels, amorphous alloys and the like can be suitably used. Especially, low-specific-gravity high-strength titanium alloys and aluminum alloys are preferred. For the head main body 3, stainless steels (e.g. SUS630, SUS255, SUS450 etc.), maraging steels, soft irons, nickel base alloys can be suitably used. Especially, stainless steels, soft irons and maraging steels are preferred. In order to increase the moment of inertia and the sweet spot area while reducing the club head weight, the specific gravity of the face plate material is smaller than that of the main frame material. It is of course possible to combine these metal parts with a resin part and/or a fiber reinforced resin part.

The face plate 2 is made up of a substantially flat main portion defining a front surface 4, a rear surface 5 and a circumferential surface 6, and a flange 8 formed along the peripheral edge of the main portion to protrude backwards from the rear surface 5. The front surface 4 is provided with fine face grooves FL. Except for the face grooves FL, the club face F is flat. When viewed from the front, the face plate 2 has a shape similar to the head main body 3, namely, it has a convexly curved lower side, a straight heel side, a convexly curved toe side, and an upper side which is almost straight but slightly convexly curved. The size of the contour is slightly smaller than that of the head main body 3.

The face plate main portion (2) may have a variable thickness distribution such that an annular peripheral zone has a reduced thickness and thus the central part is thicker, for example. In the following embodiments, however, the main portion is provided with a substantially constant thickness (tf). Although the required minimum thickness depends on the metal material used, it is preferable for the durability that the thickness (tf) is not less than 1.0 mm, more preferably more than 1.5 mm, still more preferably more than 2.0 mm. If the thickness (tf) is too large, however, it becomes difficult to obtain an improved rebound characteristic. Therefore, it is preferable that the thickness (tf) is not more than 4.0 mm, more preferably less than 3.5 mm, still more preferably less than 3.0 mm.

Figure 4:
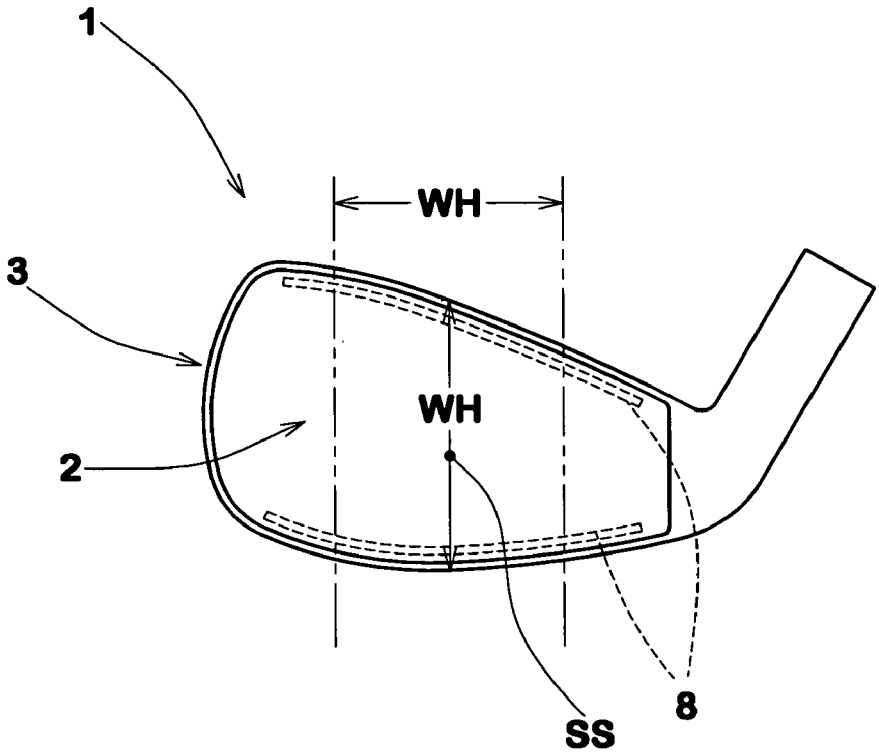
FIG. 4 and FIG. 5 are schematic front views each showing another example of the arrangement of the flange.
Figure 5:
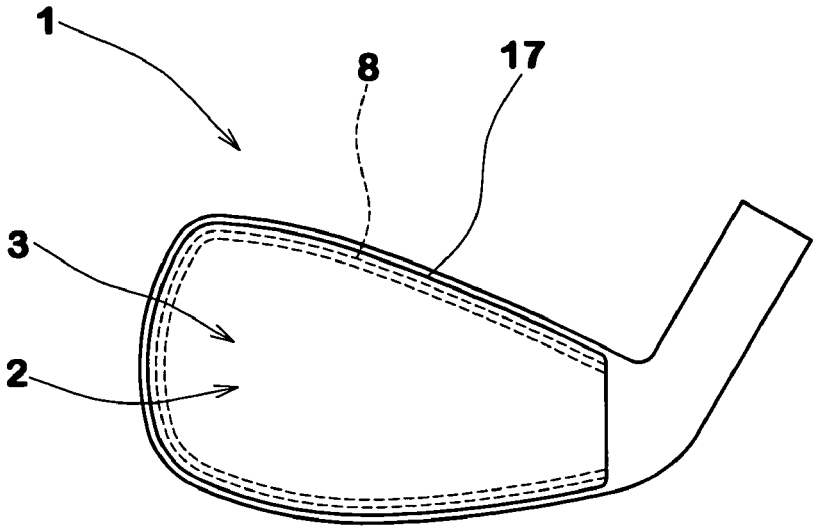

In the example shown in FIG. 3, the flange 8 is formed continuously along the entire peripheral edge of the face plate main portion (2). But, this is not always necessary. As shown in FIG. 4, the flange 8 can be formed the upper and lower edges at least along. In this case, the zone in which the flange 8 should be disposed is centered on the sweet spot Ss with respect to the horizontal direction and ranges from the sweet spot Ss towards the heel and toe by at least 50% of the height WH of the club head. Thus, as shown in FIG. 5, it is also possible to form the flange 8 along the upper, toe-side and lower edges.

The flange 8 has an outer circumferential surface 9, a rear end surface 10, and an inner circumferential surface 11. The rear end surface 10 is substantially parallel with the front surface 4 of the face plate main portion. The outer circumferential surface 9 is aligned with the above-mentioned circumferential surface 6 of the face plate main portion. The inner circumferential surface 11 is substantially parallel with the outer circumferential surface 9.

The thickness P1 of the flange 8 measured between the outer and inner circumferential surfaces 9 and 11 is substantially constant throughout its protruding length P2 from the rear surface 5 to the rear end surface 10.

The face plate main portion (2) is provided on the corner of the front surface 4 and the circumferential surface 6 with a cut-off portion 7. The cut-off portion 7 is formed continuously along the entire circumference of the face plate 2 as shown in FIG. 3. But it is also possible to from the discontinuous cut-off portion 7 along the circumference of the face plate 2. It may be possible that the cut-off portion 7 has a straight cross-sectional shape as shown in FIG. 13, but in the examples shown in FIGS. 1-12, the cut-off portion 7 has a L-shaped cross-sectional shape defined by two orthogonal faces 7*a* and 7*b*. It is preferable that the face 7*b* intersects the circumferential surface 6 at 90 degrees plus/minus 10 degrees. As far as the intersecting angle is within such a range, a concave cross-sectional is also possible aside from the L-shaped cross-sectional.

As to the dimensions of the cut-off portion 7, if the maximum depth r1 measured in parallel with the front surface 4 from the circumferential surface 6 to the farthest point on the face 7*a*, and the maximum depth r2 measured perpendicular to the front surface 4 from the front surface 4 to the farthest point on the face 7*b*, are too small, then it becomes difficult to obtain a sufficient engaging force between the cut-off portion 7 and the undermentioned hook portion 17 and as a result, the durability tends to decrease. Therefore, the depth r1 is not less than 0.5 mm, preferably more than 0.8 mm, more preferably more than 1.0 mm, and the depth r2 is not less than 1.0 mm, preferably not less than 1.5 mm.

On the other hand, if the depth r1 is too large, it becomes difficult to press the undermentioned hook portion 17 into the cut-off portion 7 not to form a gap therebetween. Therefore, the depth r1 is not more than 2.5 mm, preferably less than 2.0 mm. If the depth r2 is too large, the strength of the face plate 2 is liable to decrease. Therefore, the depth r2 is not more than 3.0 mm, preferably less than 2.5 mm.

The depth r2 is preferably more than the depth r1 (r2>r1), and the ratio (r2/r1) is preferably not less than 1.2, but not more than 4.0, preferably less than 2.0.

The above-mentioned head main body 3 has an annular frame work 12 made up of a top blade portion 12*a*, a sole portion 12*b*, a toe portion 12*c* and a heel portion 12*d*, as shown in FIG. 3, to define an opening at the front of the head main body 3 into which the face plate 2 fits. The heel portion 12*d* is integrally formed with the above-mentioned hosel portion 1B.

The annular frame work 12 comprises an outer circumferential wall 14, and a backside wall 19 at the rear end of the outer circumferential wall 14.

The backside wall 19 may be formed as a complete wall without opening as far as a certain space is formed between the backside wall 19 and the face plate 2 to prevent their direct contact at impact. In each embodiment, however, in order to shift the mass towards the peripheral and thereby increase the sweet spot area and moment of inertia, the backside wall 19 is provided with a through hole (O), and accordingly it is formed as a wall extending continuously around the through hole (O). Further, a lower part of the backside wall 19 extending along the sole portion 12*b* is increased in the thickness and cross-sectional area when compared with the other part, and further, such lower part rising from the sole portion 12*b* is increased in the rinsing height from the toe and hell towards the center in order to lower the center of gravity G of the club head.

The outer circumferential wall 14 extends up to the front surface 4 of the face plate 2, while closely contacting with the outer circumferential surface 9 of the flange 8 and the circumferential surface 6 of the face plate main portion (2).

In order to prevent the face plate 2 from coming off from the opening, the outer circumferential wall 14 is provided at the front end thereof with a hook portion 17 protruding into the above-mentioned cut-off portion 7. The front surface of the hook portion 17 is flush with the front surface 4.

In each embodiment, the combination of the cut-off portion 7 and hook portion 17 is provided along the entire circumference of the face plate 2. But, it is also possible to provide the combination along the upper and lower edges of the face similarly to the flange 8 shown in FIG. 4 or along the upper, toe-side and lower edge of the face similarly to the flange 8 shown in FIG. 5.

In any case, the total length of the cut-off portion 7 is not less than 0.6, preferably more than 0.8, more preferably more than 0.9 times the entire circumference.

such limitation is also applied to the flange 8, namely, the total length of the flange 8 is not less than 0.6, preferably more than 0.8, more preferably more than 0.9 times the length of the entire peripheral edge of the face plate main portion (2). The cut-off portion 7 may be formed in the position corresponding to the flange 8. But, it is also possible to form it in a different position, for example, the cut-off portion 7 is formed along the entire circumference, and the flange 8 is formed partially as shown in FIG. 4 or 5.

Corresponding to the position of the above-mentioned flange 8, the annular frame work 12 is provided with a securing groove 13 into which the flange 8 is fitted.

The securing groove 13 is defined by a slit between the above-mentioned outer circumferential wall 14 and an inner wall 15. The inner wall 15 is formed inside the outer circumferential wall 14 to protrude from the backside wall 19.

The inner wall 15 closely contacts with the flange 8 to support the inner circumferential surface 11 of the flange 8 in at least the rear end portion of the flange 8. The groove bottom 16 closely contacts with the rear end 10 of the flange 8 so as to precisely position the face plate.

If the width of the securing groove 13 or the thickness P1 of the flange 8 is too small, the rigidity of the flange 8 is liable to become insufficient to decrease the durability. If too large, on the other hand, it becomes difficult to improve the rebound characteristic. Therefore, the width or thickness P1 is not less than 0.5 mm, preferably more than 1.0 mm, more preferably more than 1.5 mm, still more preferably more than 2.0 mm, but not more than 4.0 mm, preferably less than 3.5 mm, more preferably less than 3.0 mm.

The protruding length P2 of the flange 8 measured perpendicularly to the front surface 4 is not less than 1.0 mm, preferably more than 1.5 mm, more preferably more than 2.0 mm in order to provide a sufficient securing force between the face plate 2 and head main body 3. However, in view of the rigidity and deformation at impact, it is preferable that the protruding length P2 is not more than 5.0 mm, more preferably less than 4.0 mm, still more preferably less than 3.0 mm.

The contact length Lc of the inner wall 15 with the inner circumferential surface 11 of the flange 8 is not less than 0.5 mm, preferably more than 1.0 mm, more preferably more than 1.5 mm, but not more than 4.0 mm, preferably less than 3.0 mm, more preferably less than 2.5 mm in view of strength and weight reduction.

The thickness W2 of the inner wall 15 is not less than 0.5 mm, preferably more than 1.0 mm, more preferably more than 1.5 mm, still more preferably more than 2.0 mm in view of the strength and durability thereof and the joint strength.

Similarly, the thickness W1 of the outer circumferential wall 14 is not less than 0.5 mm, preferably more than 1.0 mm, more preferably more than 1.5 mm, still more preferably more than 2.0 mm in view of the strength and durability thereof and the joint strength. However, if the thickness W1 is too large, it becomes difficult to improve the rebound characteristic. Therefore, the thickness W1 is not more than 4.0 mm, preferably less than 3.5 mm, more preferably less than 3.0 mm. This limitation is applied to the top blade portion 12*a* and sole portion 12*b* at least. As the toe portion 12*c* and heel portion 12*d* are far from the sweet spot SS, it is not always necessary to apply this limitation to these portions.

In a cross section of the head including the center of gravity G of the club head and being perpendicular to the club face F as shown in FIGS. 6 and 8, the ratio (Wi/WH) of the unsupported length Wi of the rear surface 5 of the face plate 2 to the height WH of the club head, both measured in parallel with the club face F, is not less than 0.70, preferably more than 0.80, but not more than 0.95, preferably less than 0.90.

Specifically, the unsupported length Wi is not less than 35 mm, preferably more than 37 mm, more preferably more than 39 mm, but not more than 50 mm, preferably less than 48 mm, more preferably less than 45 mm.

Figure 7:
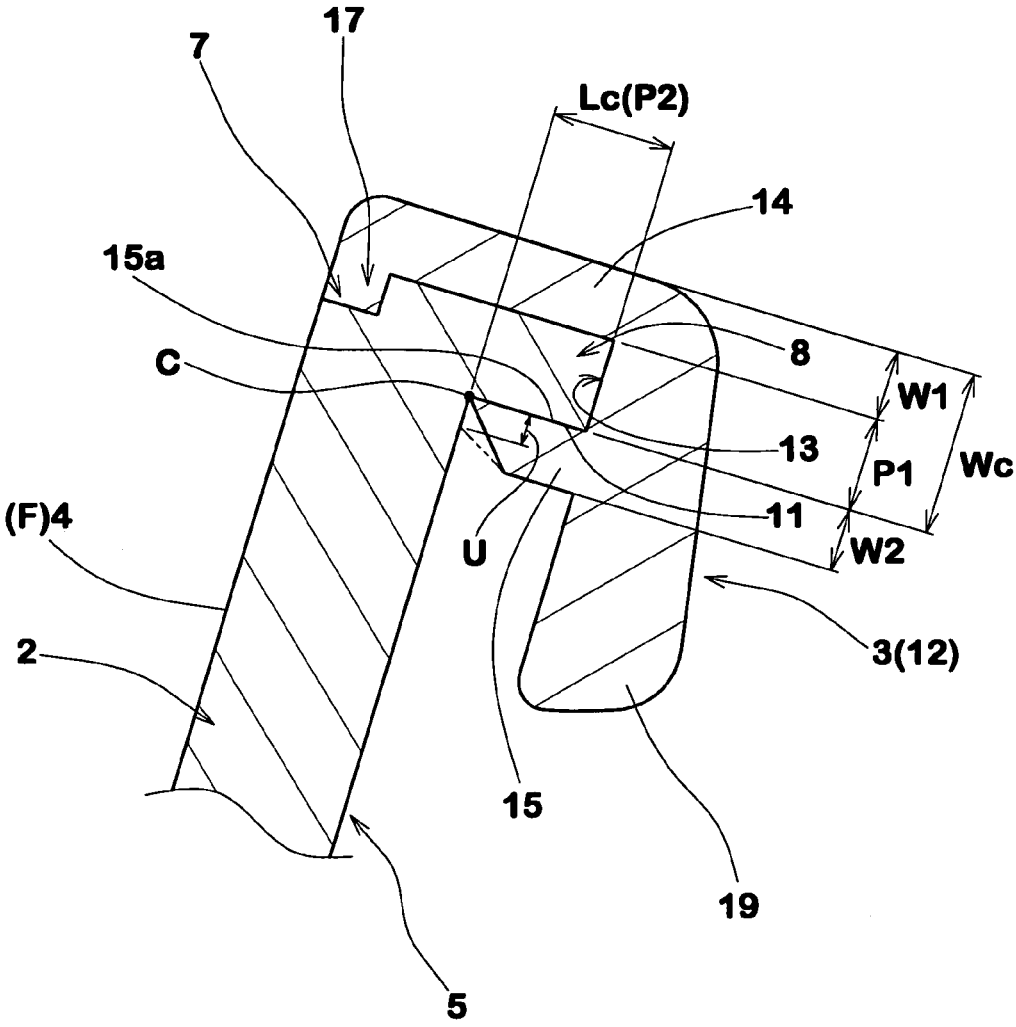
FIG. 7 is a partial cross-sectional view showing another embodiment of the present invention.

FIGS. 6-8 show examples of the inner wall 15. In the example shown in FIG. 6, the inner wall 15 terminates before the rear surface 5 of the face plate main portion (2). In the example shown in FIG. 7, the inner wall 15 reaches to the rear surface 5, and the inside corner of the inner wall 15 is cut off. In the example shown in FIG. 8, the inner wall 15 reaches to the rear surface 5, and the front end surface 15*b* of the inner wall 15 is parallel with the rear surface 5 of the face plate main portion (2) and contacts with the rear surface 5.

In FIG. 6, as the front end of the inner wall 15 does not contact with the rear surface 5 of the face plate main portion (2), the above-mentioned unsupported length Wi of the rear surface 5 can be maximized to improve the rebound characteristic at the maximum. In this case, the minimum distance Ls therebetween is more than 0.05 mm, preferably more than 0.7 mm, more preferably more than 1.0 mm, but not more than 3.0 mm, preferably less than 2.0 mm, more preferably less than 1.5 mm.

In FIG. 7, as the inner wall 15 reaches to the rear surface 5, the above-mentioned contact length Lc is maximized to provide the maximum support for the inner circumferential surface 11 of the flange 8. But, as the inside corner of the inner wall 15 is cut off, it is possible to increase the unsupported length Wi to improve the rebound characteristic. If the cutting off starts from the outside corner (C) as shown in FIG. 7, the unsupported length Wi becomes maximum. By changing the distance (U) of the start position from the corner (C) as indicated in broken line, the unsupported length Wi can be changed (decreased) to change the rebound characteristic. In the example shown in FIG. 7, the cutting line is straight, but it can be a curved line such as convex line and concave line.

In FIG. 8, as the entire width W2 of the inner wall 15 contacts with the face plate main portion, the unsupported length Wi becomes minimum.

In the case of FIG. 8 especially, if the thickness W2 of the inner wall 15 is too large, as the unsupported length Wi is decreased, it becomes difficult to improve the rebound characteristic. Therefore, the thickness W2 is not more than 4.0 mm, preferably less than 3.5 mm, more preferably less than 3.0 mm.

In any case, a support width Wc which is defined as the distance measured in parallel with the club face F from the edge of the unsupported area of the face plate main portion (2) to the outer circumferential surface P of the outer circumferential wall 14 (excluding heel portion 12*d*), is set in the range of not more than 9 mm, preferably less than 6 mm, more preferably less than 5 mm, but not less than 2 mm, preferably more than 3 mm, more preferably more than 4 mm.

Incidentally, the support width Wc in FIG. 6 is equal to the total of thicknesses W1 and P1. The support width Wc in FIG. 8 is equal to the total of thicknesses W1, P1 and W2. The support width Wc in FIG. 7 is W1+P1+U, wherein 0=<U<W2.

In the examples shown in FIGS. 6-8, the bottom 16 of the securing groove 13 is substantially parallel with the front surface 4 of the face plate 2, but it is possible to modify as follows.

Figure 9:
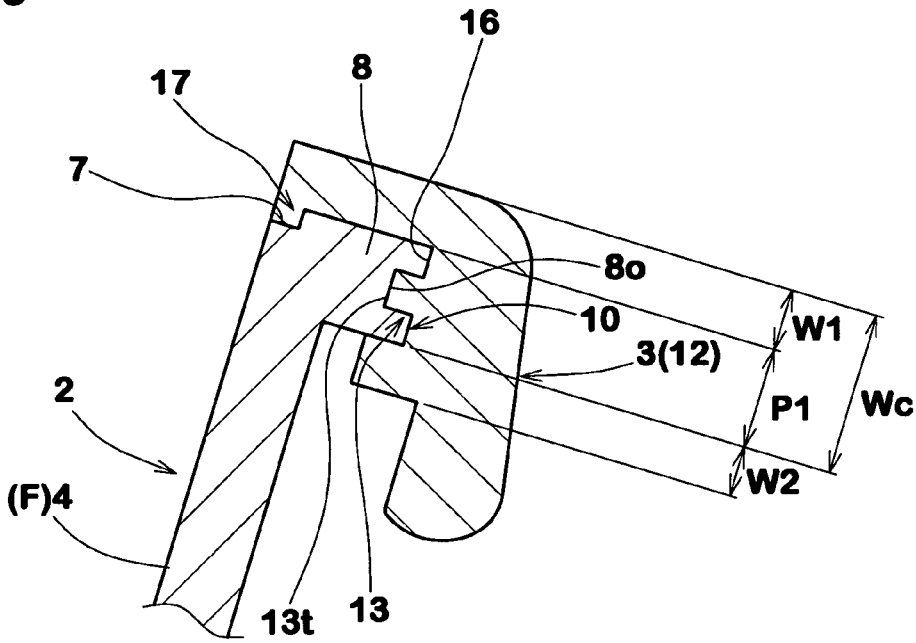
FIG. 9 and FIG. 10 are cross-sectional views each showing a modification of the embodiment shown in FIG. 6.
Figure 10:
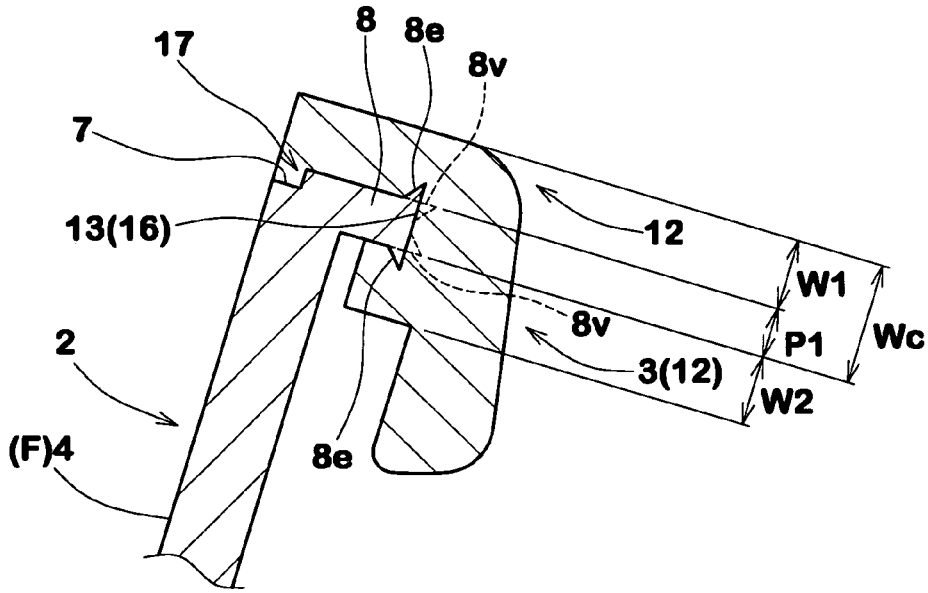

FIGS. 9-10 each show a modification of the example shown in FIG. 6.

In FIG. 9, the rear end of the flange 8 is provided with a groove 8*o* extending along the entire length of the flange 8, and accommodating thereto the bottom 16 of the securing groove 13 is provided with a rib 13*t* which fits into the groove 8*o*.

This structure can improve the engaging force between the flange and securing groove especially in a direction parallel to the club face. Thus, it is effectual to employ when the distance between the face plate main portion and the backside wall 19 is short and accordingly the inner wall 15 is small.

In FIG. 10, in order to improve the engaging force in a direction perpendicular to the club face, the flange 8 is provided at the rear end with an increased thickness portion 8*v*, and the securing groove 13 is provided near the bottom 16 with an increased width portion 8*e*. The increased width portion 8*e* protrudes toward both sides of the groove 13 to form dents on the opposite lateral faces of the groove, and the increased thickness portion 8*v* protrudes into the dents to be secured.

Such increased width portion 8*e* can be formed as follows: As shown in FIG. 10, the flange 8 provided at the rear end with deformable protrusions 8*v* is first formed. Then the flange 8 is pressed into the securing groove 13 so that the protrusions 8*v* are pressed against the almost flat groove bottom 16 and the protrusions 8*v* cause plastic deformation towards the dents of the securing groove 13. To facilitate such deformation, the opposite surfaces of the protrusions 8*v* are inclined towards the dents.

These structures shown in FIGS. 9-10 can be combined with the inner walls 15 shown in FIGS. 7-8 aside from FIG. 6.

Figure 11:
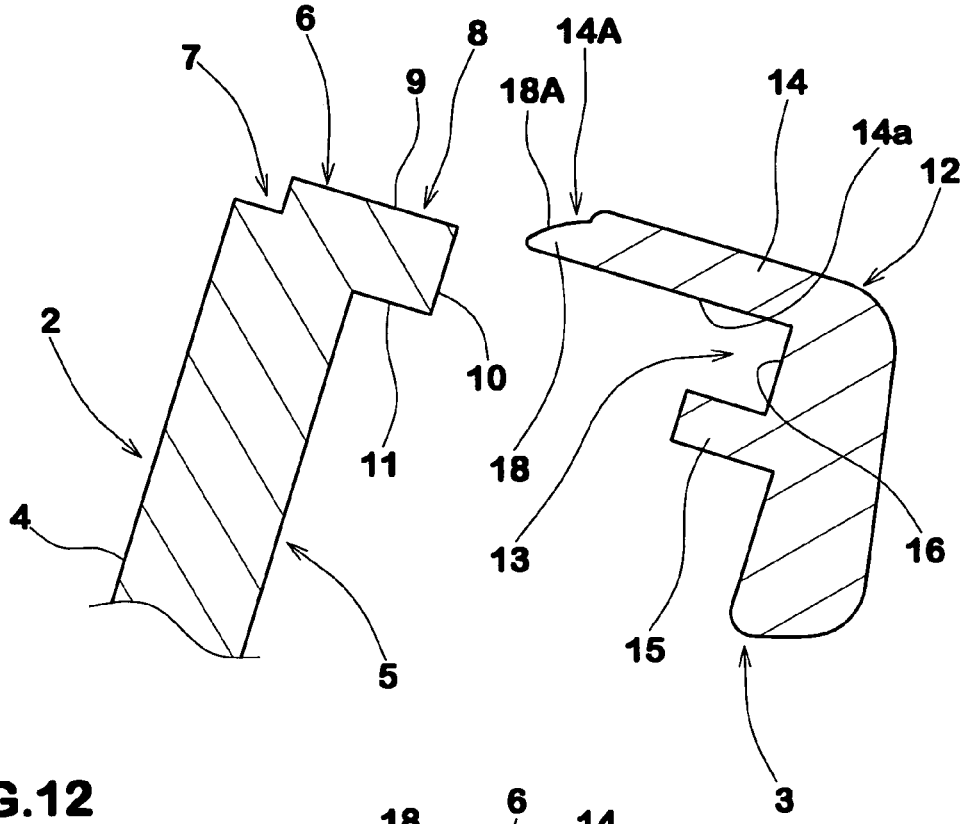
FIG. 11 and FIG. 12 are cross-sectional views for explaining a process of forming the hook portion.
Figure 12:
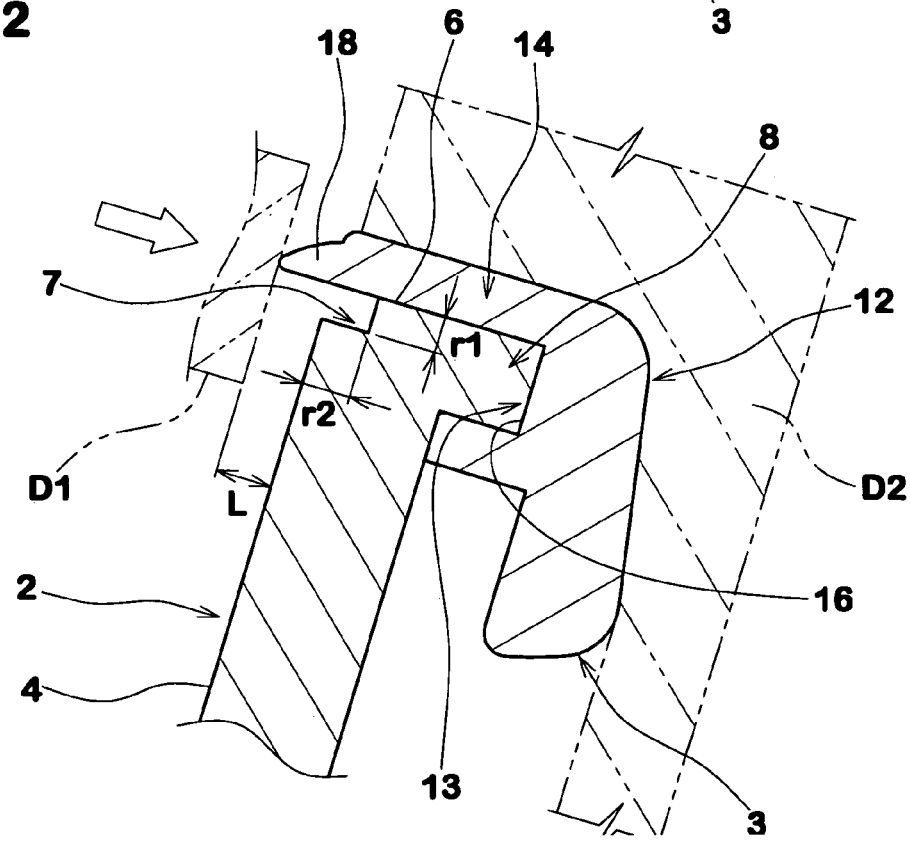
Figure 13:
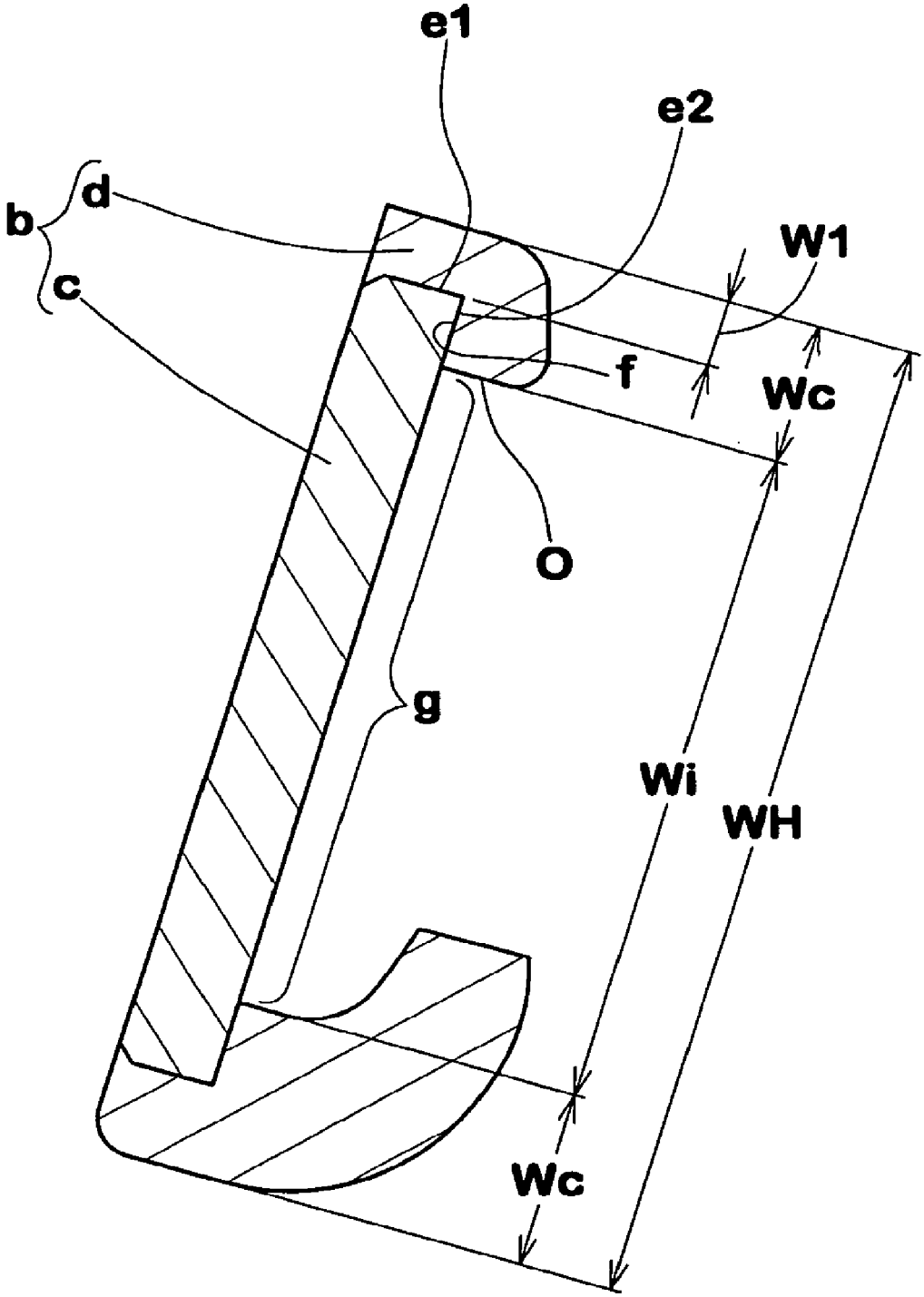
FIG.13 PRIOR ART
FIG. 13 is a cross-sectional view showing a conventional club head structure.

FIGS. 11-12 show a method of forming the above-mentioned hook portion 17.

The head main body 3 which is provided at the front end 14A of the outer circumferential wall 14 with a crushable protrusion 18 is first made as shown in FIG. 11, wherein the crushable protrusion 18 tapers towards the front end by inclining the outer surface 18*a*, but the inner surface is flush with the inner circumferential surface 14*a* of the outer circumferential wall 14. Then, the face plate 2 is press fitted into the opening so that the flange 8 fits into the securing groove 13 as shown in FIG. 12. The head main body 3 is set in a die D2, and a die D1 is pressed against the protrusion 18 so that the protrusion 18 causes plastic deformation and the deformed protrusion 18 enters the cut-off portion 7 as the hook portion 17.

In order to secure the face plate further and to fill an inevitable gap between the face plate 2 and head main body 3, adhesive agent can be used at the same time.

According to need, finishing work such as grinding and polishing is made on the deformed protrusion 18.

In order that the deformed protrusion 18 fills the significant volume of the cut-off portion 7, the protruding length L of the protrusion 18 measured from the club face to the extreme end is not less than 0.5 mm, preferably not less than 1.0 mm, and the ratio (L/r1) of the protruding length L to the above-mentioned depth r1 is not less than 0.50, preferably more than 0.70, more preferably more than 0.8, still more preferably more than 0.9. However, if the protrusion 18 is too large, the deformed protrusion 18 becomes liable to protrude onto the club face and the production efficiency decreases. Therefore, the protruding length L is not more than 2.5 mm, preferably not more than 2.0 mm, and the ratio (L/r1) is not more than 2.0, preferably less than 1.5, more preferably less than 1.2, still more preferably less than 1.1.

When a compress deformation is caused on the outer circumferential wall 14 by the press operation, the contact pressure and the frictional force between the flange 8 and securing groove 13 is increased to further increase the engaging force therebetween.

Comparison Tests

Golf club heads (number five iron having a real loft angle of 24 degrees) having specifications shown in Table 1 were made and tested for the rebound characteristic and durability. In each head, the main body was made of stainless steel SUS630 through lost-wax precision casting, and the face plate was made of titanium alloy Ti-6Al-4V.

The thickness (tf) of the face plate main portion was a constant value of 3.0 mm. The face plate was press fit into the opening of the head main body and secured by deforming the protrusion 18 as described above.

Rebound Characteristic Test

According to the "Procedure for Measuring the velocity Ratio of a Club Head for conformance to Rule 4-1e, Appendix II, Revision 2 (Feb. 8, 1999), United States Golf Association", the coefficient of restitution-(COR) of each club head was obtained. The results are shown in Table 1. The larger the value, the better the rebound characteristic.

Durability Test:

Each head was attached to a FRP shaft (SRI Sports Ltd. MP-300, Flex R) to make a 38-inch five iron, and the golf club was mounted on a swing robot. Then, each head hit golf balls (SRI Sports Ltd. "EVERIO") 3000 times at the head speed of 40 meter/second, while checking the junction of the face plate and head main body every 100 times. The results are shown in Table 1, wherein "A" means that no damage was found after the 3000-time hitting test, and numerical values mean the number of hitting times at which a damage was observed.

TABLE 1

| Head | Ref. 1 | Ref. 2 | Ex. 1 | Ex. 2 | Ex. 3 | Ex. 4 | Ex. 5 | Ex. 6 | Ex. 7 |
|---|---|---|---|---|---|---|---|---|---|
| Structure | FIG. 13 | FIG. 13 | FIG. 8 | FIG. 6 | FIG. 6 | FIG. 6 | FIG. 6 | FIG. 6 | FIG. 6 |
| Flange | — | — | FIG. 5 | FIG. 5 | FIG. 5 | FIG. 5 | FIG. 5 | FIG. 4 | FIG. 3 |
| Total length N1(mm) | 0 | 0 | 185 | 185 | 185 | 185 | 185 | 125 | 220 |
| N1/N2 *1 | 0 | 0 | 0.8 | 0.8 | 0.8 | 0.8 | 0.8 | 0.6 | 1 |
| Club head height WH (mm) | 47 | | | | | | | | |
| Unsupported length Wi (mm) | 33 | 39 | 35 | 39 | 39 | 39 | 39 | 39 | 39 |
| Support width Wc (mm) | 7 | 4 | 6 | 4 | 4 | 4 | 4 | 4 | 4 |
| Thickness W1 (mm) | 3 | 2 | 2 | 2 | 2 | 2 | 2 | 2 | 2 |
| Thickness P1 (mm) | — | — | 2 | 2 | 2 | 2 | 2 | 2 | 2 |
| Thickness W2 (mm) | — | — | 2 | 2 | 2 | 2 | 2 | 2 | 2 |
| Distance Ls (mm) | — | — | 0 | 1 | 1 | 1 | 1 | 1 | 1 |
| Length P2 (mm) | 0 | 0 | 3 | 3 | 3 | 3 | 3 | 3 | 3 |
| Depth r1(mm) | — | — | 1 | 1 | 1 | 0.5 | 2.5 | 1 | 1 |
| Depth r2(mm) | — | — | 2 | 2 | 1 | 2 | 3 | 2 | 2 |
| COR | 0.78 | 0.805 | 0.805 | 0.811 | 0.81 | 0.811 | 0.811 | 0.808 | 0.811 |
| Durability | A | 900 | A | A | A | A | A | A | A |

*1 N2 is the circumference of face plate = 220 mm

The invention claimed is:

1. A golf club head comprising a face plate and a head main body to which the face plate is attached so as to form a hollow behind the face plate, the face plate comprising a main portion and a flange, the main portion having a front surface, rear surface and circumferential surface, and provided on the corner of the front surface and circumferential surface with a cut-off portion, the flange protruding from the rear surface and extending along the peripheral edge of the main portion, the head main body provided at the front with an opening into which the face plate is fit, wherein a securing groove into which the flange is fit is provided in the opening, the securing groove is defined between an inner wall and an outer wall, and the outer wall extends to said front surface and provided at the front end thereof with a hook portion protruding into said cut-off portion.

2. The golf club head according to claim 1, wherein said inner wall extends toward the face plate but terminates before the rear surface.

3. The golf club head according to claim 1, wherein said inner wall extends toward the face plate so that the front end thereof reaches to the rear surface.

4. The golf club head according to claim 3, wherein said front end has an inside corner cut off to reduce the contact area with the rear surface.

5. The golf club head according to claim 1, wherein said flange and securing groove are provided continuously along the peripheral edge of the face plate.

6. The golf club head according to claim 1, wherein the cut-off portion and hook portion are provided continuously along the peripheral edge of the face plate.

7. The golf club head according to claim 1, wherein the outer wall has a thickness (W1) in a range of not more than 4.0 mm.

8. The golf club head according to claim 1, wherein the flange has a thickness (P1) in a range of not more than 4.0 mm.

9. The golf club head according to claim 1, wherein the contact length (Lc) of the inner wall with the flange is more than 1.0 mm.

10. The golf club head according to claim 1, wherein the hook portion is formed by plastic deformation.

* * * * *